United States Patent [19]

Oka

[11] 4,293,630

[45] Oct. 6, 1981

[54] ELECTROPHOTOGRAPHIC PHOTOSENSITIVE MEMBER

[75] Inventor: Kozo Oka, Ebina, Japan

[73] Assignee: Rank Xerox Limited, London, England

[21] Appl. No.: 142,199

[22] Filed: Apr. 21, 1980

[30] Foreign Application Priority Data

May 29, 1979 [JP] Japan ..... 54-65672

[51] Int. Cl.[3] ..... G03G 5/14

[52] U.S. Cl. ..... 430/59; 430/66; 430/83

[58] Field of Search ..... 430/58, 59, 66, 67, 430/83

[56] References Cited

U.S. PATENT DOCUMENTS

| | | | |
|---|---|---|---|
| 3,997,342 | 12/1976 | Bailey | 430/59X |
| 4,072,520 | 2/1978 | Rochlitz | 430/59 |
| 4,081,274 | 3/1978 | Horgan | 430/59 |

*Primary Examiner*—Roland E. Martin, Jr.

*Attorney, Agent, or Firm*—Peter H. Kondo; James P. O'Sullivan; John E. Beck

[57] ABSTRACT

An electrophotographic photosensitive body comprising a conductive support, a photoconductive layer thereon and a protective layer. The protective layer comprises a binder resin, an aromatic diamine and an organic halogen capable of producing a free halogen atom, such as iodoform, carbon tetraiodide, pentabromoethane, p-nitrotribromoacetophenone, trichloroacetophenone, tribromomethylphenylsulfone, bis(tribromomethyl)-sulfoxide, and p-bromobenzenedichlorosulfonamide.

2 Claims, No Drawings

ELECTROPHOTOGRAPHIC PHOTOSENSITIVE MEMBER

This invention relates to an electrophotographic photosensitive body for use in an electrophotographic process known as the Carlson process, comprising a conductive support having provided thereon in sequence a photoconductive layer and a surface-protecting layer.

Typical electrophotographic-photosensitive bodies which have so far been used include those comprising a conductive base having vacuum-deposited thereon a photosensitive layer of Se, Se-Te alloy, Se-As alloy, or the like, and those comprising a conductive support having coated thereon an organic photoconductor like PVK (polyvinylcarbazole)-TNF (2,4,7-trinitrofluoroenone). However, they have the defects that, in repeated uses, they are liable to suffer delamination or be damaged during removal of residual toner, or that the photosensitive layer is liable to be worn so easily that it must be prematurely replaced. It is known to provide a protective surface layer on the photosensitive body to overcome these disadvantages. One such surface layer is an insulating layer comprising a material with comparatively high dielectric properties. This insulating layer has the advantage that it can be present as a thick layer and be of a comparatively high mechanical strength. However, in order to repeatedly use this type of photosensitive body, there is required a special latent image-forming process such as first charging, second charging with an opposite polarity, then imagewise exposure, or first charging, second charging with simultaneously imagewise exposure, then uniform exposure. These processes require two or more charging steps in one copying procedure, which requires complicated apparatuses, leading to unstable characteristics and high cost.

An imaging member which does not require the aforesaid special latent image-forming process and which can be used for the so-called Carlson process of charging in the dark followed by imagewise exposure is the member of the present invention having a specific protective layer. This protective layer must be made less insulating to prevent electric charge from accumulating on or in the protective layer.

In conventionally employed processes, a quaternary ammonium salt or the like is added to the protective layer. Generally, however, conductivity of such materials greatly varies due to absorption of ambient moisture. In a dry state, conductivity of the protective layer is reduced so much that charge will accumulate, resulting in fogging of images, whereas in a highly humid state, conductivity increases more than is necessary, and hence charge migration takes place in a lateral direction, resulting in blurring of images. Further, for use in the Carlson process, the conventional protective layer must be comparatively thin, i.e., not more than several microns, which is unsatisfactory form the point of view of mechanical strength. In addition, materials added for lowering insulating properties color the protective layer, which causes detrimental influences on spectral sensitivity of the light-sensitive body.

This invention relates to a photosensitive body having a protective layer usable in the aforesaid Carlson process. An object of the present invention is to provide a photosensitive body which does not suffer from the accumulation of charge in repeated uses. Another object is to provide a photosensitive body which is stable to changing ambient conditions, and which shows favorable optical properties even though comparatively thick.

The present invention is an electrophotographic photosensitive body having on the surface of a photoconductive layer a protective layer comprising a specific aromatic amine compound and an organic halogen compound capable of producing a free halogen atom dispersed in a binder resin.

The aromatic amine compounds to be used in the present invention are represented by following general formula (I) or (II):

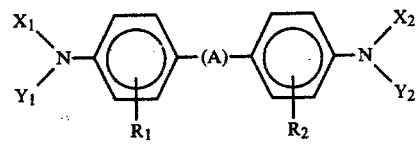

(I)

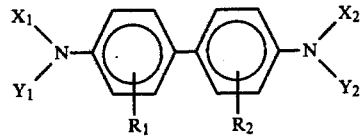

(II)

wherein $X_1$, $X_2$, $X_1$, and $Y_2$ each represents an alkyl group or a substituted or unsubstituted aryl group, $R_1$ and $R_2$ each represents a hydrogen atom, an alkyl group containing 1–6 carbon atoms, or a halogen atom, and —(A)— represents a member selected from the group consisting of members (III)–(IX) wherein

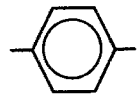

is (III)

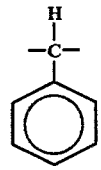

is (IV)

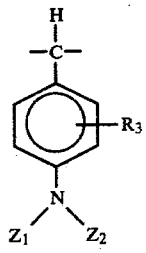

is (V)

wherein $Z_1$ and $Z_2$ each represents an alkyl group containing 1–6 carbon atoms, or a substituted or unsubstituted aryl group, and $R_3$ represents a hydrogen atom or an alkyl group containing 1–6 carbon atoms,

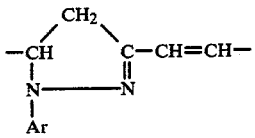

wherein Ar represents a substituted or unsubstituted aryl group,

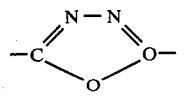

is (VII)

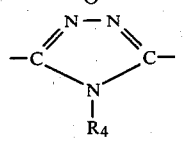

is (VIII)

wherein $R_4$ represents an alkyl group containing 1–6 carbon atoms, and

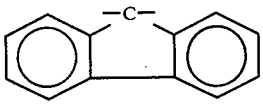

is (IX)

The binder resin to be used in the protective layer of the present invention can be a polyester resin, polycarbonate resin, polystyrene resin, polyurethane resin, epoxy resin, acrylic resin, polyvinyl chloride resin, vinyl chloride-vinyl acetate copolymer resin, etc.

As the organic halogen compound capable of producing a free halogen atom, which can be used in the present invention, there are illustrated iodoform, carbon tetraiodide, pentabromoethane, p-nitrotribromoacetophenone, trichloroacetophenone, tribromomethylphenylsulfone, bis(tribromomethyl)sulfoxide, p-bromobenzenedichlorosulfonamide, etc. If necessary, active light may be irradiated so as to accelerate production of the free radical group.

The composition ratio in the protective layer varies depending upon the combination of the materials, but it is preferable to add 5–100 parts by weight of the aromatic amine compound and 0.01–50 parts by weight of the organic halogen compound per 100 parts by weight of the binder resin. Selection of the composition ratio within the above-described range permits one to form a protective layer having a thickness of about 15–20$\mu$ or more. Needless to say, the thickness may be made thin, if necessary. The thickness of the protective layer is preferably from about 2–30$\mu$.

The photoconductive layer of the present invention can be a deposited film of Se, Se-Te alloy, Se-As alloy, Se-Sb alloy, Se-Bi alloy, or the like. It also can be a coating of an organic photoconductor, such as PVK/TNF, or an inorganic photoconductor like ZnO or CdS dispersed in a binder, or a stratum of a charge-generating layer and a charge transfer layer. It is particularly noteworthy that photoconductors which cannot be used in ordinary electrophotographic processes due to weak mechanical strength can be used in the present invention.

In the present invention, photogeneration of charge carriers is conducted in the photoconductive layer, and hence the protective layer must be substantially transparent to transmit light to which the photoconductive layer is sensitive. Also, an interlayer may be provided in the present invention between the protective layer and the photoconductive layer to improve adhesiveness or charge-retaining property.

The photosensitive body of the present invention is fundamentally different from the conventional photosensitive body known as stratum type photosensitive body comprising a conductive base having provided thereon a charge-generating layer and a charge transfer layer. That is, in the photosensitive body in accordance with the present invention, charge pattern is formed between a protective layer-photoconductive interface and a conductive base. On the other hand, in the conventional stratum type photosensitive body, the charge pattern is formed between the surface of the charge transfer layer and the conductive base. In addition, with the protective layer, the electrostatic charge must be implanted from the surface of the protective layer into the protective layer-photoconductive interface, whereas with the charge transfer layer, charge must stay on the surface. Further, the protective layer is thin in thickness as compared with the photoconductive layer so as to produce enough difference in electric potential between light portions and dark portions, whereas the charge transfer layer must be thicker than the charge-generating layer. Thus, the protective layer of the present invention is required to have different functions and different interfacial properties.

The electrophotographic photosensitive body of the present invention constituted as stated above has various advantages over conventional ones. That is:

(1) it has a surface layer which permits the formation of a latent image without employing a special process;

(2) when repeatedly used, there is substantially no accumulation and increase of residual charge;

(3) it is generally unaffected by change in temperature and humidity (4) the protective layer can be made comparatively thick;

(5) the structure includes a protective layer which does not substantially influence the photosensitivity of the photosensitive layer; and (6) the structure includes a protective layer having high mechanical strength.

The present invention will be described in more detail by the following examples.

EXAMPLE I

20 Parts by weight of 1-phenyl-3-(p-dimethylaminostyryl)-5-(p-dimethylaminophenyl)pyrazole and 10 parts by weight of iodoform were added to 100 parts by weight of a polyester resin (trade name: Du Pont 49000; made by E. I. du Pont de Nemours & Co., Inc.), and dissolved in tetrahydrofuran. The resulting solution was coated on an amorphous selenium deposited film (60$\mu$ thick) provided on an aluminum base to obtain a photosensitive body having a 15-$\mu$ thick protective layer. When steps of positive charging, imagewise exposure, development, transfer, and cleaning were repeated using this photosensitive body, excellent copies were consistently obtained.

EXAMPLE 2

40 Parts by weight of 2,5-bis(4-diethylaminophenyl)-oxadiazole-1,3,4 and 5 parts by weight of p-bromobenzene-dichlorosulfonamide were added to 100 parts by weight of a polyester resin (trade name: VIRON 200; made by Toyo Spinning Co., Ltd.), and dissolved in dichloromethane. The resulting solution was coated on a $As_2Se_3$ deposited film (55$\mu$ thick) provided on an aluminum base, and dried to obtain a photosensitive body having a 15-$\mu$ thick protective layer. When this photosensitive body was tested in the same manner as in Example 1, excellent copies were consistently obtained.

EXAMPLE 3

15 Parts by weight of 4,4'-bis(N,N'-diethylamino)-triphenylmethane and 5 parts by weight of bis(tribromomethyl)sulfone were added to 100 parts by weight of a polycarbonate resin (trade name: PANLITE N; made by Teijin Chemicals, Ltd.), and dissolved in dichloromethane. The resulting solution was coated on a Se-Te alloy deposited film (60μ thick) provided on an aluminum base and dried to obtain a photosensitive body having a 10-μ thick protective layer. When this photosensitive body was tested in the same manner as in Example 1, excellent copies were consistently obtained.

What is claimed is:

1. An electrophotographic photosensitive body comprising a conductive support having provided thereon, in sequence, a photoconductive layer and a protective layer, said protective layer containing in a binder resin an aromatic amine compound wherein said compound is of the following general formula (I) or (II) an an organic halogen compound capable of producing a free halogen atom:

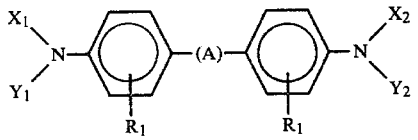

(I)

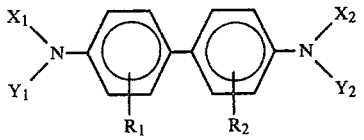

(II)

wherein $X_1$, $X_2$, $Y_1$, and $Y_2$ each is an alkyl group or a substituted or unsubstituted aryl group, $R_1$ and $R_2$ each is a hydrogen atom, an alkyl group containing 1–6 carbon atoms, or a halogen atom, and —(A)— represents a member selected from the group consisting of Members (III)–(IX) wherein

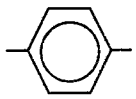

is (III)

-continued

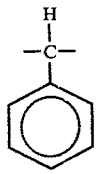

is (IV)

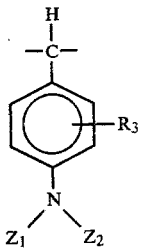

is (V)

wherein $Z_1$ and $Z_2$ each is an alkyl group containing 1–6 atoms, or a substituted or unsubstituted aryl group, and $R_3$ is a hydrogen atom or an alkyl group containing 1–6 carbon atoms,

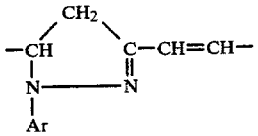

is (VI)

wherein Ar represents a substituted or unsubstituted aryl group,

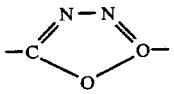

is (VII)

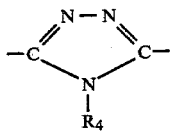

is (VIII)

wherein $R_4$ represents an alkyl group containing 1–6 carbon atoms and

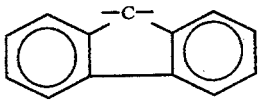

is (IX)

2. The electrophotographic photosensitive body as described in claim 1, wherein said organic halogen compound capable of producing a free halogen atom is selected from the group consisting of iodoform, carbon tetraiodide, pentabromoethane, p-nitrotribromoacetophenone, trichloroacetophenone, tribromomethylphenylsulfone, bis(tribromomethyl)-sulfoxide, and p-bromobenzenedichlorosulfonamide.

* * * * *